US005419559A

United States Patent [19]

Melanson et al.

[11] Patent Number: 5,419,559

[45] Date of Patent: May 30, 1995

[54] METAL WOOD WITH SOUND DAMPENER BAR

[75] Inventors: Daniel A. Melanson, Avon, Conn.; Steven J. Mahaffey, Hampden, Mass.

[73] Assignee: Lisco, Inc., Tampa, Fla.

[21] Appl. No.: 223,396

[22] Filed: Apr. 4, 1994

[51] Int. Cl.[6] ..... A63B 53/04

[52] U.S. Cl. ..... 273/167 H; 273/173

[58] Field of Search ..... 273/167 R, 167 F, 167 H, 273/78, 169, 171, 172, 173, 193 R, 194 R, 194 B, 77 R, 167 J

[56] References Cited

U.S. PATENT DOCUMENTS

| | | | |
|---|---|---|---|
| 1,526,438 | 2/1925 | Scott | 273/169 |
| 1,582,836 | 4/1926 | Link . | |
| 1,592,463 | 7/1926 | Marker . | |
| 1,678,637 | 7/1928 | Drevitson . | |
| 3,567,228 | 3/1971 | Lynn | 273/169 |
| 3,847,399 | 11/1974 | Raymont | 273/267 F |
| B1 3,847,399 | 9/1993 | Raymont | 273/167 F |
| 4,214,754 | 7/1980 | Zebelean | 273/167 H |
| 4,313,607 | 2/1982 | Thompson | 273/167 H |
| 4,429,879 | 2/1984 | Schmidt | 273/167 H |
| 4,432,549 | 2/1984 | Zebelean | 273/167 H |
| 4,438,931 | 3/1984 | Motomiya | 273/167 H |
| 4,489,945 | 12/1984 | Kobayashi | 273/167 H |
| 4,602,787 | 7/1986 | Sugioka et al. | 273/171 |
| 4,614,627 | 9/1986 | Curtis et al. | 264/46.6 |
| 4,681,321 | 7/1987 | Chen et al. | 273/167 H |
| 4,756,534 | 7/1988 | Thompson | 273/171 |
| 4,811,949 | 3/1989 | Kobayashi | 273/171 |
| 4,944,515 | 7/1990 | Shearer | 273/167 H |
| 5,000,454 | 3/1991 | Soda | 273/167 H |
| 5,004,241 | 4/1991 | Antonious | 273/167 H |
| 5,067,715 | 11/1991 | Schmidt et al. | 273/167 F |
| 5,141,230 | 8/1992 | Antonious | 273/167 H |
| 5,163,682 | 11/1992 | Schmidt et al. | 273/167 J |
| 5,180,166 | 1/1993 | Schmidt et al. | 273/167 F |
| 5,213,327 | 5/1993 | Long et al. | 273/167 F |

*Primary Examiner*—Sebastiano Passaniti

*Attorney, Agent, or Firm*—Donald R. Bahr; John E. Benoit

[57] ABSTRACT

A golf club head which comprises a metallic hollow body having a sole, a crown, a heel, a toe, a rear wall, and a striking face. A single web is secured to and subtends downwardly from the inner surface of the crown, with the web extending perpendicularly from the inner surface of the striking face and terminating short of the inner surface of the rear wall, the depth of the web being greatest at the inner surface of the striking face. The web is located along the transverse centerline of the club head. This web configuration substantially eliminates crown vibrations in oversized metal woods.

11 Claims, 1 Drawing Sheet

METAL WOOD WITH SOUND DAMPENER BAR

BACKGROUND OF THE INVENTION

The present invention relates generally to hollow metal woods and more specifically to hollow metal woods which include sound dampener means.

Large metal woods are used extensively by present-day golfers. These metal woods are usually made from very thin-walled metal and, thus, tend to produce "crown" vibrations which cause tinking, clinking, or any harsh un-solid feel when the wood strikes the ball.

Various structural modifications have been proposed relative to thin-walled metal woods, primarily in an attempt to strengthen the club itself and prevent cracking and buckling of the metal walls. Some very complicated inner structures have been proposed for this purpose and may incidentally reduce the shock wave concentration which would otherwise be imposed on the junction between the front wall and the top wall of the club head.

For purposes of manufacture, as well as simplicity, it would be desirable to reduce the vibrations caused by striking the ball without adding to the complexity or the weight of the club head.

SUMMARY OF THE INVENTION

The present invention provides a golf club head which comprises a metallic hollow body having a sole, a crown, a heel, a toe, a rear wall, and a striking face. The head is made of thin-walled metal and is subsequently filled with a foam plastic material or the like. A single web is secured to and subtends downwardly from the inner surface of the crown with the web extending from the inner surface of the striking face and terminating short of the inner surface of the rear wall, with the depth of the web being greatest at the inner surface of the striking face. Preferably the web is located along the centerline of the striking face and crown so as to be located above the sweet spot of the striking face.

DESCRIPTION OF THE PREFERRED EMBODIMENT

Figure 1:
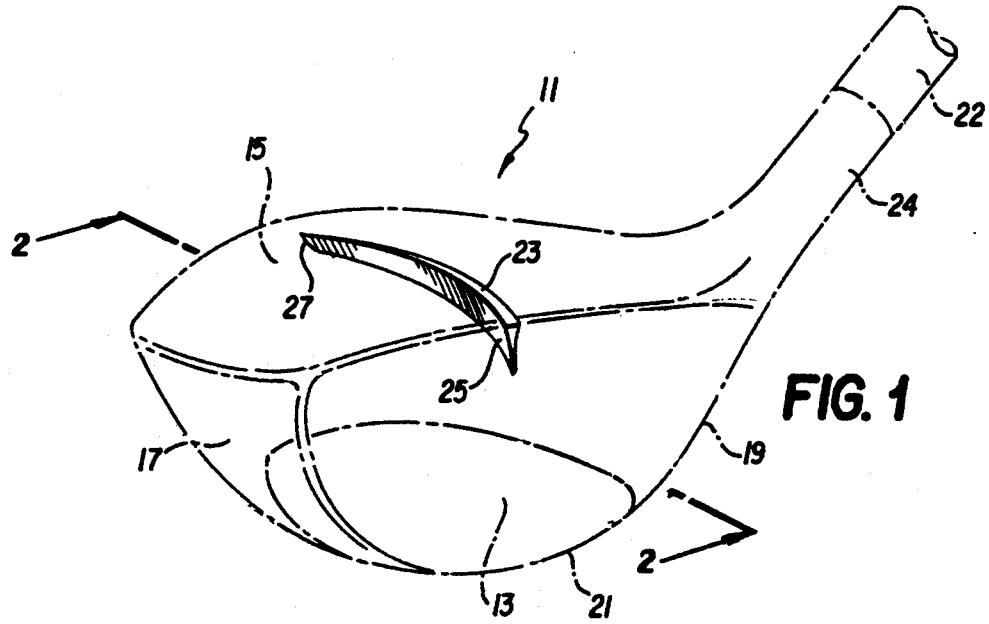
FIG. 1 shows a hollow golf club head in phantom lines with the web of the present invention shown in solid lines.

Referring to the drawings, there is shown in FIG. 1 in phantom lines head 11 of a metallic wood which includes striking face 13, crown 15, toe 17, heel 19, rear wall 20, and sole 21. Also shown are hosel 24 and shaft 22, which completes the club itself.

Figure 2:
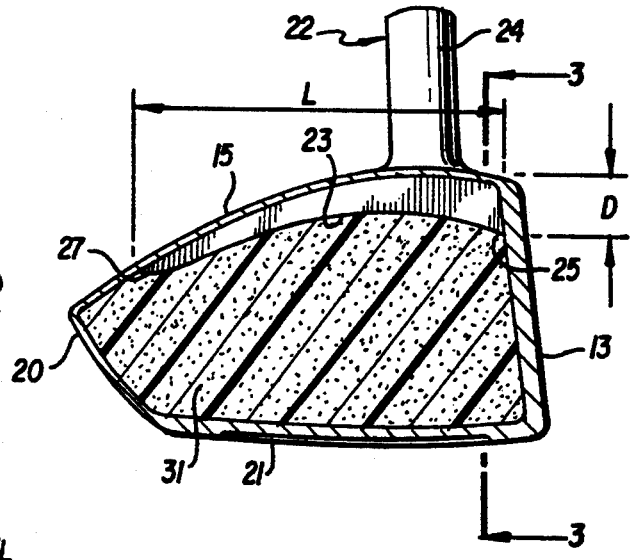
FIG. 2 is a sectional view taken along the lines 2—2 of FIG. 1 showing the actual club head.
Figure 3:
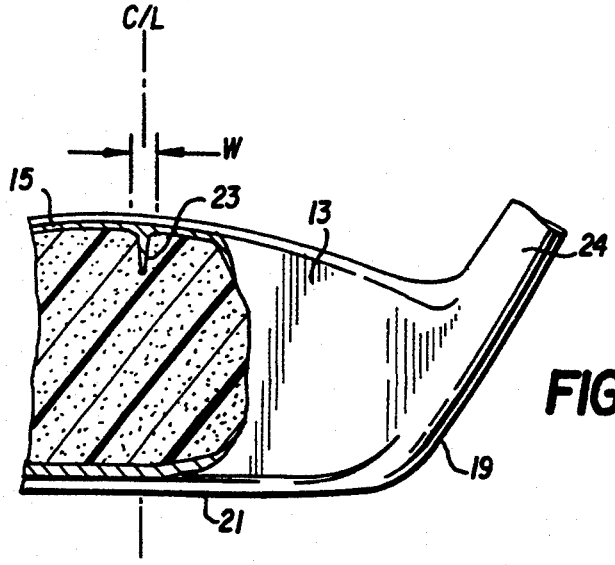
FIG. 3 is a partial sectional view taken along the lines 3—3 of FIG. 2.

Web 23 of the present invention is secured to the inner surface of the crown and extends rearwardly from its forward end 25, which contacts the inner surface of striking face 13, and terminates at its rearward end 27 short of the inner face of rear wall 20 (FIG. 2). Web 23 can be formed or cast into the head or welded or brazed thereto. FIGS. 2 and 3 show the web as being an integral part of the head structure.

Referring more specifically to FIGS. 2 and 3, it can be seen that sound dampener bar 23 has an arcuate outer edge from its front end 25 to its rear end 27. The front end, which is adjacent the inner surface of striking face 13, is the deepest part of the web. For standard metal woods, the length L of web 23 is preferably between 1.00 inch and 2.80 inches, and more preferably between 2.00 inches and 2.50 inches; and for the large oversize driver as shown, it is substantially 2.30 inches. As stated above, the selected length is such that the web terminates short of the inner face of the rear wall.

The depth D of the deepest part of web 23 is between 0.050 inch and 0.500 inch and the preferably between 0.060 inch and 0.250 inch. In the preferred embodiment, the depth is substantially 0.180 inch. As will be obvious from these dimensions and the illustrations of FIGS. 1 and 2 of the drawings, the depth D is substantially less than 50% of the maximum width of striking face 13.

Referring to FIG. 3, the web itself it quite narrow and has a width W at its widest part of between 0.015 inch and 0.500 inch and preferably between 0.030 inch and 0.125 inch. In the preferred embodiment, discussed above, the width is substantially 0.060 inch.

The depth of the web is related to its width. As the width of the web is increased, the depth may be reduced. Conversely, as the width is decreased, the depth may be increased. The above-stated parameters include ranges available relative to variations in width and depth of the web.

In any of the woods the distance L of web 23, as shown in FIG. 2, is at least 50% of the overall width of the crown between the inner surface of striking face 13 and the point at which the crown meets rear wall 20.

The interior of the metal wood may be filled with foam plastic 31 or the like.

Present oversized metal heads do not have any means of making a solid feeling head in a large thin-walled configuration. The use of the dampener web, as described above, provides the feel of smaller-headed drivers in large oversized configurations. This is accomplished due to the fact that the web eliminates "crown vibrations" which cause tinking, clinking, or any harsh un-solid feel in such oversized metal woods.

The above description and drawings are illustrative only since variations in construction can be made without departing from the invention, the scope of which is to be limited only by the following claims.

I claim:

1. A golf club head comprising a metallic hollow body having a sole, a rear wall having an inner and outer surface, a crown having an inner and outer surface, a heel, a toe, and a striking face having an inner and outer surface; and a single web secured to and subtending downwardly from the inner surface of said crown, said web extending from the inner surface of said striking face and terminating short of the inner surface of said rear wall, with the depth of said web being greatest at said inner surface of said striking face, the depth of said web being substantially less than 50% of the maximum width of said striking face from said crown to said sole.

2. The golf club head of claim 1 wherein said web is located along the transverse centerline of said head and extends substantially perpendicular to said striking face.

3. The golf club head of claim 1 wherein the length of said web is between 1.0 inch and 2.8 inches.

4. The golf club head of claim 1 wherein the length of said web is between 2.0 inches and 2.5 inches.

5. The golf club head of claim 1 wherein the length of said web is substantially 2.3 inches.

6. The golf club head of claim 1 wherein the length of said web is at least 50% of the width of the transverse centerline of said crown.

7. The golf club head of claim 1 wherein the maximum depth of said web is between 0.050 inch and 0.500 inch.

8. The golf club head of claim 1 wherein the maximum depth of said web is between 0.060 inch and 0.250 inch.

9. The golf club head of claim 1 wherein the maximum depth of said web is substantially 0.180 inch.

10. The golf club head of claim 1 wherein the maximum width of said web is between 0.015 inch and 0.050 inch.

11. The golf club of claim 1 wherein said web extends from said inner surface of said striking face along at least 50% per cent of the inner surface of said crown.

* * * * *